US010107534B2

(12) United States Patent
Kumakura et al.

(10) Patent No.: US 10,107,534 B2
(45) Date of Patent: Oct. 23, 2018

(54) EXPANSION VALVE AND PIPE MOUNTING STRUCTURE THEREOF

(71) Applicant: TGK CO., LTD., Tokyo (JP)

(72) Inventors: Takanao Kumakura, Tokyo (JP); Takeshi Kaneko, Tokyo (JP); Ryosuke Satake, Tokyo (JP); Shinji Saeki, Tokyo (JP); Takeshi Watanabe, Tokyo (JP); Takafumi Jyonouchi, Tokyo (JP)

(73) Assignee: TGK CO., LTD., Tokyo (JP)

( * ) Notice: Subject to any disclaimer, the term of this patent is extended or adjusted under 35 U.S.C. 154(b) by 60 days.

(21) Appl. No.: 15/012,767

(22) Filed: Feb. 1, 2016

(65) Prior Publication Data

US 2016/0231037 A1 Aug. 11, 2016

(30) Foreign Application Priority Data

Feb. 6, 2015 (JP) ..... 2015-021923

(51) Int. Cl.
*F25B 41/00* (2006.01)
*F25B 41/06* (2006.01)

(52) U.S. Cl.
CPC .... *F25B 41/062* (2013.01); *F25B 2341/0683* (2013.01); *F25B 2500/01* (2013.01); *F25B 2500/12* (2013.01); *F25B 2500/13* (2013.01)

(58) Field of Classification Search
CPC ..... F25B 2341/0683; F25B 2500/12; F25B 2500/13; F25B 2341/06; F25B 2341/068
USPC ..... 62/296
See application file for complete search history.

(56) References Cited

U.S. PATENT DOCUMENTS 6,076,366 A * 6/2000 Takano ..... B60H 1/00571 62/196.1
6,942,160 B2 * 9/2005 Kobayashi ..... F16K 27/0236 236/92 B
2007/0209387 A1 * 9/2007 Hirota ..... F25B 41/062 62/527

FOREIGN PATENT DOCUMENTS

JP 2013-242129 5/2013 ..... F25B 41/06

* cited by examiner

*Primary Examiner* — David Teitelbaum
*Assistant Examiner* — Paul Schwarzenberg
(74) *Attorney, Agent, or Firm* — Martine Penilla Group, LLP

(57) ABSTRACT

A pipe mounting structure of an embodiment allows a pipe, which is connected to an outlet side of an evaporator, to be mounted on a second passage of an expansion valve in such a manner that the pipe is inserted into an inlet port, and allows a pipe, which is connected to an inlet side of a compressor, to be mounted on the second passage in such a manner that the pipe is inserted into an outlet port. These pipes are mounted so that the pipes face each other with a shaft therebetween. The pipe mounting structure includes a natural vibration suppressing structure configured to prevent or suppress natural vibration of a gas column having anti-nodes of a standing wave at an open end of one of the pipes and an open end of the other pipe.

3 Claims, 9 Drawing Sheets

EXPANSION VALVE AND PIPE MOUNTING STRUCTURE THEREOF

CLAIM OF PRIORITY

This application claims priority to Japanese Patent Application No. JP2015-021923, filed on Feb. 6, 2015, of which is incorporated herein by reference.

BACKGROUND OF THE INVENTION

1. Field of the Invention

The present invention relates to a pipe mounting structure of an expansion valve suitable for use in a refrigeration cycle.

2. Description of the Related Art

A refrigeration cycle in an automotive air conditioner generally includes a compressor for compressing a circulating refrigerant, a condenser for condensing the compressed refrigerant, an expansion valve for throttling and expanding the condensed liquid refrigerant and delivering the resulting spray of refrigerant, and an evaporator for evaporating the misty refrigerant to cool the air in a vehicle interior by evaporative latent heat. The expansion valve is, for example, a thermostatic expansion valve that senses the temperature and the pressure of the refrigerant on the outlet side of the evaporator, and opens or closes a valve section so that the refrigerant delivered from the evaporator has a predetermined degree of superheat, to control the flow rate of the refrigerant to be delivered to the evaporator.

The expansion valve has a body in which a first passage through which the refrigerant flowing from the condenser toward the evaporator passes and a second passage through which the refrigerant having returned from the evaporator passes to be delivered to the compressor are formed. The first passage includes a valve hole, and a valve element disposed facing the valve hole. The valve element moves toward and away from the valve hole to adjust the flow rate of the refrigerant flowing toward the evaporator. A power element that senses the temperature and the pressure of the refrigerant flowing through the second passage and operates in response to the sensed temperature and pressure is provided at one end of the body. The drive force of the power element is transmitted to the valve element via an elongated shaft. The shaft extends through an insertion hole formed in a partition that divides between the first passage and the second passage, and is slidably supported in the insertion hole. One end of the shaft is connected to the power element, and the other end thereof extends through the valve hole and is connected to the valve element (refer to Japanese Unexamined Patent Application Publication No. 2013-242129, for example).

In such an expansion valve, a Karman vortex may be generated on the downstream side of the shaft while the refrigerant flowing through the second passage passes along the shaft, and abnormal noise (hereinafter also referred to as "Karman vortex sound") may be caused thereby. This is considered to be due to resonance caused when the eigenvalue (natural frequency) of a space where the shaft is present in the second passage and the frequency of the Karman vortex correspond to each other (coincidence of eigenvalues). An approach to such a problem may be to provide a design so that the eigenvalue of the space and the frequency of the Karman vortex are shifted from each other. Even if such an approach is carried out, however, the eigenvalues may become coincident again as a result of a change in the eigenvalue of the space caused by a change in a joint of the expansion valve, for example. Furthermore, since the frequency of a Karman vortex also changes with the flow rate of the refrigerant, the eigenvalues may become coincident as a result of such a change. This may result in generation of Karman vortex sound.

SUMMARY OF THE INVENTION

The present invention has been made in view of such circumstances, and a purpose thereof is to prevent or reduce generation of Karman vortex sound in an expansion valve.

One embodiment of the present invention relates to a pipe mounting structure applicable to an expansion valve provided in a refrigeration cycle. The expansion valve is configured to throttle and expand refrigerant passing through a valve section, the refrigerant being introduced via a heat exchanger, supply the expanded refrigerant to an evaporator, sense pressure and temperature of refrigerant having returned from the evaporator to control an opening degree of the valve section, and deliver the refrigerant toward a compressor. The expansion valve includes: a body having a first inlet port through which the refrigerant from the heat exchanger is introduced, a first outlet port through which the refrigerant is delivered toward the evaporator, a first passage connecting the first inlet port and the first outlet port, a valve hole formed in an intermediate portion of the first passage, a second inlet port through which the refrigerant having returned from the evaporator is introduced, a second outlet port through which the refrigerant is delivered toward the compressor, and a second passage connecting the second inlet port and the second outlet port; a valve element configured to move toward and away from the valve hole to close and open the valve section; a power element provided on the body on a side opposite to the first passage with respect to the second passage and configured to sense temperature and pressure of the refrigerant flowing through the second passage and operate in response to the sensed temperature and pressure; and a shaft having a first end side extending across the second passage and connected to the power element and a second end side extending through a partition between the first passage and the second passage and connected to the valve element, the shaft being configured to transmit drive force of the power element to the valve element In such an expansion valve, the pipe mounting structure allows a first pipe to be mounted on the second inlet port in such a manner that the first pipe is inserted into the second inlet port and allows a second pipe to be mounted on the second outlet port in such a manner that the second pipe is inserted into the second outlet port, the first pipe being connected to an outlet side of the evaporator and the second pipe being connected to an inlet side of the compressor. The first pipe and the second pipe are mounted to face each other with the shaft therebetween. The pipe mounting structure includes a natural vibration suppressing structure configured to prevent or suppress natural vibration of a gas column having antinodes of a standing wave at an open end of the first pipe and an open end of the second pipe.

By employing this embodiment, the natural vibration suppressing structure prevents or suppresses natural vibration of a gas column having antinodes of a standing wave at the open end of the first pipe and the open end of the second pipe. That is, the eigenvalue itself of a space between the open end of the first pipe and the open end of the second pipe can be eliminated or the substantial influence of the eigenvalue of the space can be eliminated. As a result, generation of Karman vortex sound can be prevented or suppressed regardless of the frequency value of the Karman vortex.

Another embodiment of the present invention relates to an expansion valve. The expansion valve includes a body having: a first pipe connecting part configured to receive a first pipe, which is connected to an outlet side of the evaporator, in such a manner that the first pipe is inserted into the second inlet port; a second pipe connecting part configured to receive a second pipe, which is connected to an inlet side of the compressor, in such a manner that the second pipe is inserted into the second outlet port; and an inclined surface between the first pipe connecting part and the second pipe connecting part, the inclined surface facing an end opening of the first pipe connected to the first pipe connecting part in an axial direction of the first pipe and being inclined with respect to a plane perpendicular to an axis of the second passage.

By employing this embodiment, a shaft is positioned between the first pipe and the second pipe mounted onto the body. With this structure, even when a wave of refrigerant flowing through the second passage is reflected therein, the refrigerant is reflected in a direction deviated from the axis because of the presence of the inclined surface, and the natural vibration of a gas column is thus prevented or suppressed. That is, the eigenvalue itself of a space between the first pipe connecting part and the second pipe connecting part can be eliminated or the substantial influence of the eigenvalue of the space can be eliminated. As a result, generation of Karman vortex sound can be prevented or suppressed regardless of the frequency value of the Karman vortex.

A still another embodiment of the present invention relates to an expansion valve. The expansion valve includes a body having a first pipe connecting part configured to receive a first pipe, which is connected to an outlet side of the evaporator, in such a manner that the first pipe is inserted into the second inlet port; a second pipe connecting part configured to receive a second pipe, which is connected to an inlet side of the compressor, in such a manner that the second pipe is inserted into the second outlet port; and an inclined surface between the first pipe connecting part and the second pipe connecting part, the inclined surface facing an end opening of second pipe connected to the second pipe connecting part in an axial direction of the second pipe and being inclined at an angle of 45 degrees or larger with respect to a plane perpendicular to an axis of the second passage.

With this structure, even when a wave of refrigerant flowing through the second passage is reflected therein toward the upstream side, the refrigerant is reflected in a direction deviated from the axis because of the presence of the inclined surface, and the natural vibration of a gas column is thus prevented or suppressed. As a result, generation of Karman vortex sound can be prevented or suppressed regardless of the frequency value of the Karman vortex.

DETAILED DESCRIPTION OF THE INVENTION

Figure 1:
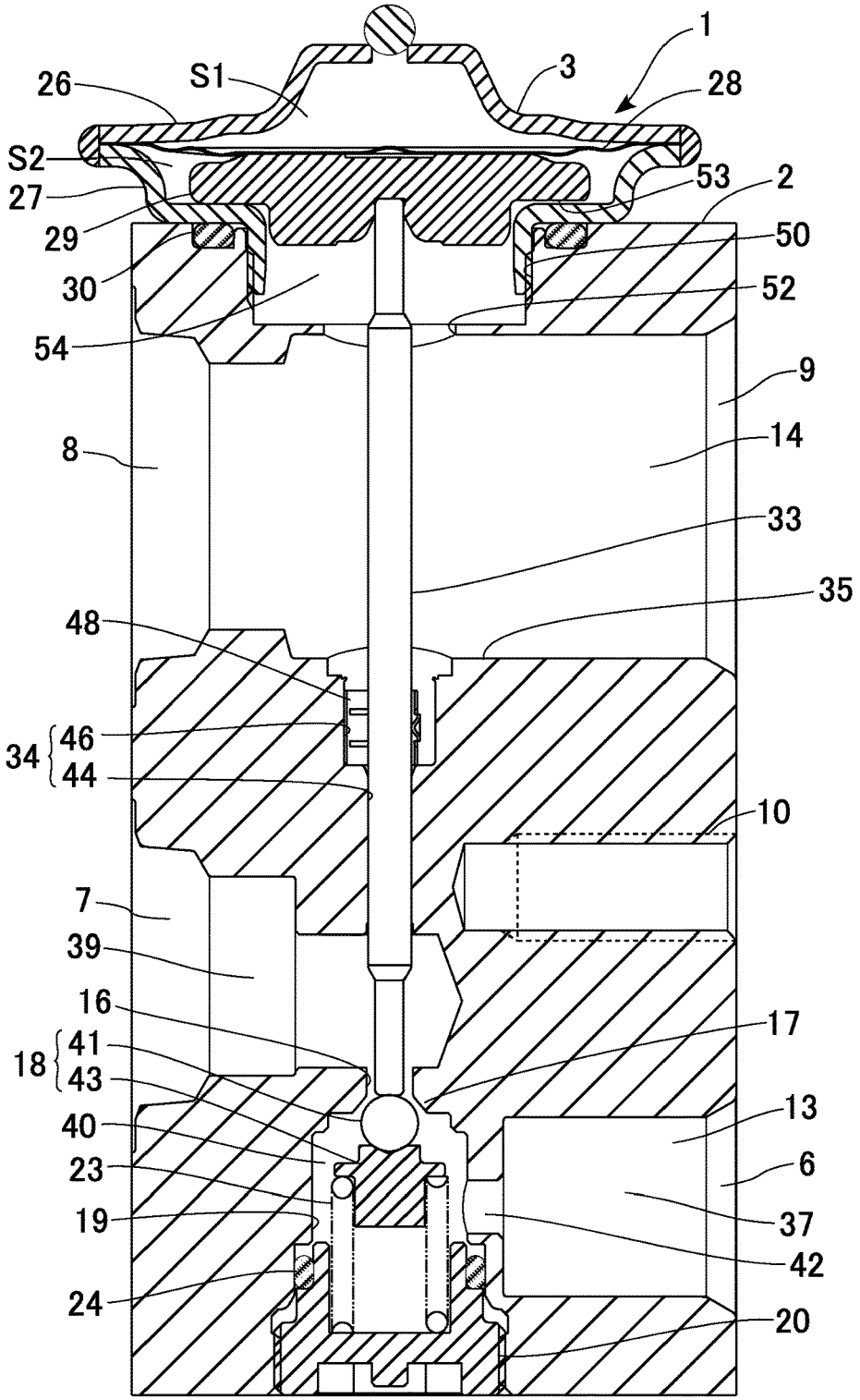
FIG. 1 is a cross-sectional view of an expansion valve according to a first embodiment.

The invention will now be described by reference to the preferred embodiments. This does not intend to limit the scope of the present invention, but to exemplify the invention.

Embodiments of the present invention will now be described in detail with reference to the drawings. In the following description, for convenience of description, the positional relationship in each structure may be expressed with reference to how each structure is depicted in the drawings. Note that components that are substantially the same in the following embodiments and the modifications thereof will be designated by the same reference numerals and that redundant description thereof may be omitted as appropriate.

First Embodiment

First, an expansion valve to which a pipe mounting structure according to a first embodiment is applicable will be described.

The expansion valve is a thermostatic expansion valve applicable to a refrigeration cycle of an automotive air conditioner. The refrigeration cycle includes a compressor for compressing a circulating refrigerant, a condenser for condensing the compressed refrigerant, a receiver for separating the condensed refrigerant into gas and liquid, an expansion valve for throttling and expanding the separated liquid refrigerant and delivering the resulting spray of refrigerant, and an evaporator for evaporating the misty refrigerant to cool the air in a vehicle interior by evaporative latent heat.

FIG. 1 is a cross-sectional view of the expansion valve according to the first embodiment.

The expansion valve 1 has a body 2 formed by extrusion molding of a material made of an aluminum alloy and performing predetermined cutting on the member obtained by the extrusion molding. The body 2 has a prism shape, and has a valve section in the inside thereof for throttling and expanding the refrigerant. A power element 3 that functions as a "drive section" is disposed at an end in the longitudinal direction of the body 2.

The body 2 has, on sides thereof, an inlet port 6 through which a high-temperature and high-pressure liquid refrigerant is introduced from the receiver side (condenser side), an outlet port 7 through which the low-temperature and low-pressure refrigerant resulting from the throttling expansion through the expansion valve 1 is delivered toward the evaporator, an inlet port 8 through which the refrigerant evaporated by the evaporator is introduced, and an outlet port 9 through which the refrigerant having passed through the expansion valve 1 is delivered to the compressor side. A screw hole 10 in which a not-shown stud bolt for mounting a pipe can be screwed is formed between the inlet port 6 and the outlet port 9. Each of the ports is connected with a pipe joint.

In the expansion valve 1, the inlet port 6, the outlet port 7, and a refrigerant passage connecting these ports constitute a first passage 13. A valve section is formed in an intermediate portion of the first passage 13. The refrigerant introduced through the inlet port 6 is throttled and expanded into a spray through the valve section, and delivered toward the evaporator through the outlet port 7. In addition, the inlet port 8, the outlet port 9, and a refrigerant passage connecting these ports constitute a second passage 14. The second passage 14 extends straight and an intermediate portion thereof communicates with the inside of the power element 3. Note that "straight" used herein refers to extension along one axis (straight line) and includes such a shape of the passage that has a stepped portion or inclined face as long as the shape is symmetric with respect to the axis. Part of the refrigerant introduced through the inlet port 8 is supplied to the power element 3 by which the temperature of the refrigerant is sensed. The refrigerant having passed through the second passage 14 is delivered toward the compressor through the outlet port 9.

A valve hole 16 is formed at the intermediate portion of the first passage 13, and a valve seat 17 is formed by an open end edge of the valve hole 16 on the side of the inlet port 6. A valve element 18 is disposed facing the valve seat 17 from the side of the inlet port 6. The valve element 18 has a spherical ball valve element 41 for opening and closing the valve section by leaving and touching the valve seat 17, and a valve element support 43 for supporting the ball valve element 41 from below, which are joined together.

A communication hole 19 connecting the inside and the outside of the body 2 is formed at a lower end part of the body 2. The upper half of the communication hole 19 forms a valve chamber 40 in which the valve element 18 is accommodated. The valve chamber 40 communicates with the valve hole 16, and is formed coaxially with the valve hole 16. The valve chamber 40 also communicates with the inlet port 6 at a lateral side thereof via an upstream-side passage 37. The upstream-side passage 37 includes a small hole 42 that is open toward the valve chamber 40. The small hole 42 is a portion of the first passage 13 where the cross-section thereof is locally made small.

The valve hole 16 communicates with the outlet port 7 via a downstream-side passage 39. Thus, the upstream-side passage 37, the valve chamber 40, the valve hole 16, and the downstream-side passage 39 constitute the first passage 13. The upstream-side passage 37 and the downstream-side passage 39 are parallel to each other and each extend in a direction perpendicular to the axis of the valve hole 16. In a modification, the inlet port 6 or the outlet port 7 may be positioned so that projections of the upstream-side passage 37 and the downstream-side passage 39 are perpendicular to each other (so that the upstream-side passage 37 and the downstream-side passage 39 are skew with respect to each other).

An adjusting screw 20 is screwed into a lower half of the communication hole 19 so as to seal the communication hole 19 from outside. A spring 23 for biasing the valve element 18 in a valve closing direction is disposed between the valve element 18 (more specifically, the valve element support 43) and the adjusting screw 20. The load of the spring 23 can be adjusted by adjustment of the insertion amount of the adjusting screw 20 into the body 2. An O-ring 24 for preventing leakage of the refrigerant is disposed between the adjusting screw 20 and the body 2.

A recess 50 is formed at an upper end of the body 2, and an opening 52 connecting the inside and the outside of the body 2 is formed at a bottom of the recess 50. The power element 3 has a lower part screwed into the recess 50 and is mounted on the body 2 in such a manner as to seal the opening 52. A space between the recess 50 and the power element 3 constitutes a temperature sensitive chamber 54.

The power element 3 has a diaphragm 28 provided between an upper housing 26 and a lower housing 27 thereof, and a disc 29 disposed on the lower housing 27 side of the diaphragm 28. The upper housing 26 is formed by press-forming a stainless steel material into a lidded shape. The lower housing 27 is formed by press-forming a stainless steel material into a stepped cylindrical shape. The disc 29 is made of aluminum or an aluminum alloy, for example, and has a higher thermal conductivity than the upper and lower housings. The diaphragm 28 is made of a metal thin film in the present embodiment.

The power element 3 is formed in a shape of a container by making the upper housing 26 and the lower housing 27 in contact with each other at the openings thereof, mounting the diaphragm 28 so that an outer edge of the diaphragm 28 is placed between outer edges of the upper housing 26 and the lower housing 27, and welding along a circumferential joint of the upper and lower housing. The inside of the power element 3 is partitioned into a closed space S1 and an open space S2 by the diaphragm 28. A gas for sensing temperature is sealed in the closed space S1. The open space S2 communicates with the second passage 14 via the opening 52. An O-ring 30 for preventing leakage of the refrigerant is disposed between the power element 3 and the body 2. The pressure and the temperature of the refrigerant passing through the second passage 14 are transmitted to a lower surface of the diaphragm 28 through the opening 52 and a groove 53 formed on the disc 29. The temperature of the refrigerant is transmitted to the diaphragm 28 mainly by the disc 29 having a high thermal conductivity.

An insertion hole 34 is formed through a partition wall 35 between the first passage 13 and the second passage 14 at a middle part of the body 2. The insertion hole 34 is a stepped hole having a small-diameter part 44 and a large-diameter part 46. An elongated shaft 33 is slidably inserted in the small-diameter part 44. The shaft 33 is a metal (stainless steel, for example) rod disposed between the disc 29 and the valve element 18. This structure enables drive force resulting from displacement of the diaphragm 28 to be transmitted to the valve element 18 via the disc 29 and the shaft 33, so as to open and close the valve section.

An upper half of the shaft 33 extends across the second passage 14, and a lower half thereof is slidably supported in the small-diameter part 44 of the insertion hole 34. The large-diameter part 46 (which functions as a "mounting hole") contains a vibration-proof spring 48 for applying biasing force in a direction perpendicular to the direction of axis of the shaft 33, that is, a lateral load (sliding load) onto the shaft 33. The shaft 33 is subjected to the lateral load of the vibration-proof spring 48, which suppresses vibration of the shaft 33 and the valve element 18 due to refrigerant pressure fluctuation. Since a structure disclosed in Japanese Unexamined Patent Application Publication No. 2013-

242129 can be used for the vibration-proof spring 48, detailed description of a specific structure thereof will be omitted.

In the present embodiment, although no sealing member such as an O-ring is provided between the insertion hole 34 and the shaft 33, leakage of refrigerant from the first passage 13 to the second passage 14 is prevented or minimized since the clearance between the shaft 33 and the small-diameter part 44 is sufficiently small. Thus, a so-called clearance seal is achieved.

In the expansion valve 1 having the structure as described above, the power element 3 senses the pressure and the temperature of refrigerant having returned from the evaporator via the inlet port 8, and the diaphragm 28 displaces. This displacement of the diaphragm 28 results in the drive force, which is transmitted to the valve element 18 via the disc 29 and the shaft 33 so as to open and close the valve section. In the meantime, liquid refrigerant supplied from a receiver is introduced through the inlet port 6, throttled and expanded while passing through the valve section to be turned into a low-temperature and low-pressure spray of refrigerant. The refrigerant is delivered through the outlet port 7 toward the evaporator.

Figure 2A:
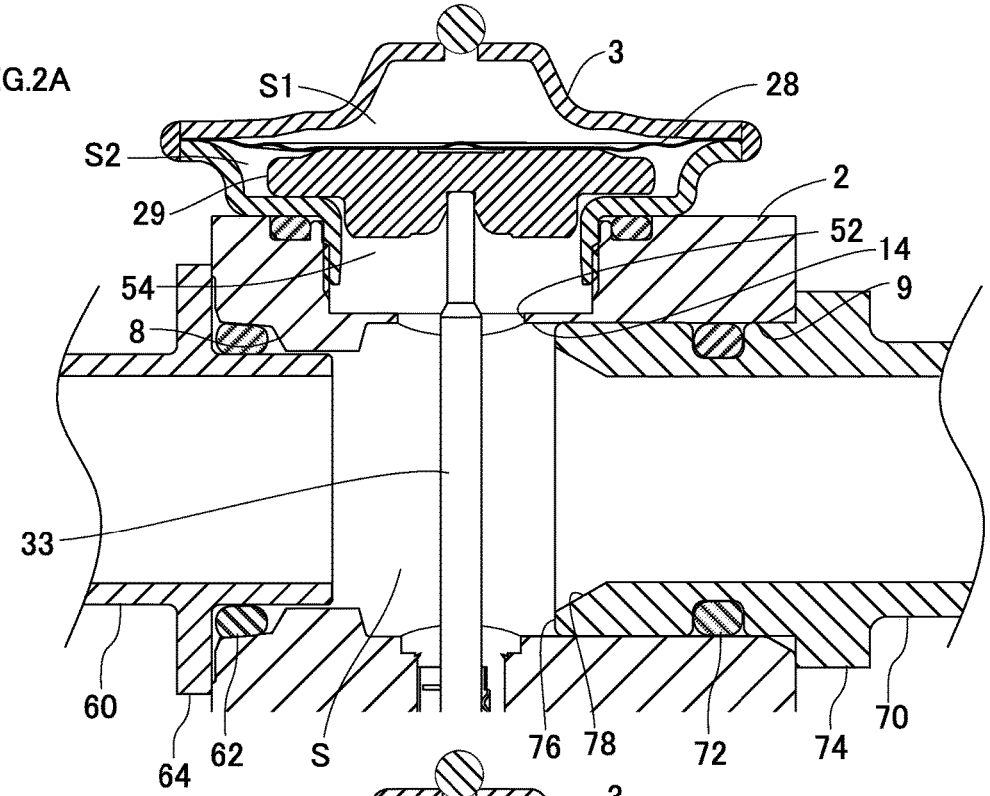
FIGS. 2A and 2B are partially enlarged cross-sectional views of main parts of pipe mounting structures.
Figure 2B:
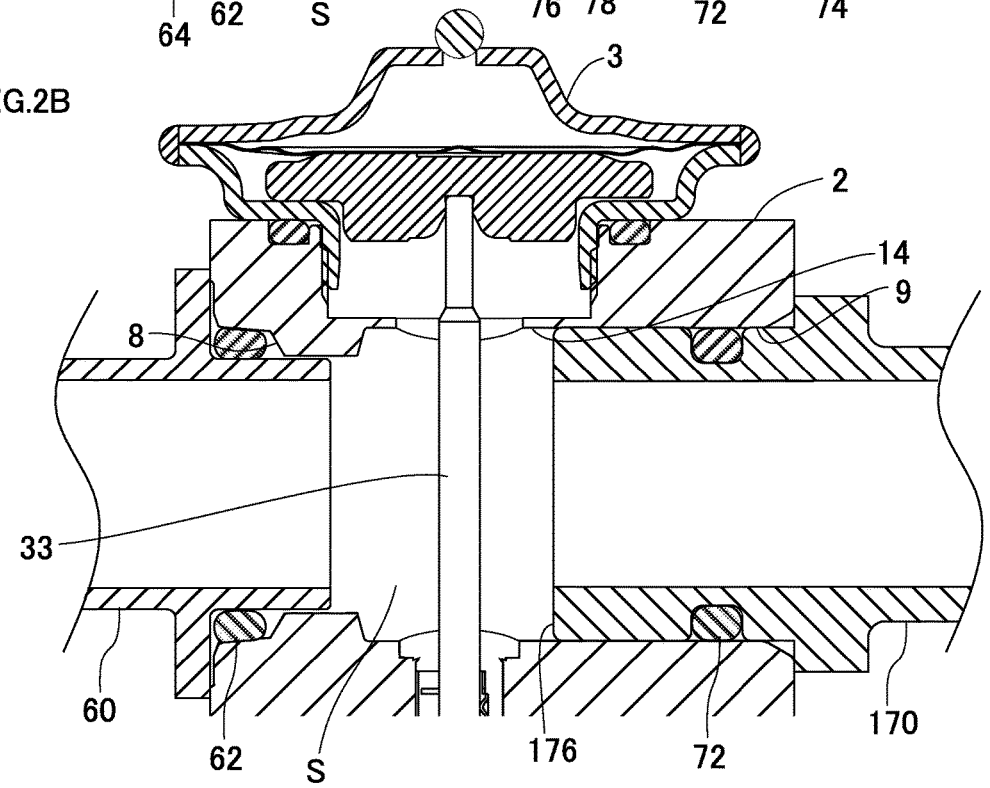

A pipe mounting structure will now be described. FIGS. 2A and 2B are partially enlarged cross-sectional views of main parts of pipe mounting structures. FIG. 2A shows a pipe mounting structure according to the present embodiment, and FIG. 2B shows a pipe mounting structure according to a comparative example.

As shown in FIG. 2A, the inlet port 8 is connected with an end portion (joint) of a pipe 60 (corresponding to a "first pipe") connecting an outlet side of the evaporator and the expansion valve 1. Specifically, the inlet port 8 and its vicinity constitute a "first pipe connecting part" capable of receiving the pipe 60 in such a manner that the pipe 60 is inserted therein. An O-ring 62 for sealing is fitted around an outer surface of the end portion of the pipe 60 so as to prevent leakage of refrigerant to the outside. In addition, a flange portion 64 protruding radially outward is formed in the vicinity of the end portion of the pipe 60. The flange portion 64 is stopped by a side face of the body 2, so that the length to which the pipe 60 is inserted into the second passage 14 is restricted and set.

The outlet port 9 is connected with an end portion (joint) of a pipe 70 (corresponding to a "second pipe") connecting an inlet side of the compressor and the expansion valve 1. Specifically the outlet port 9 and its vicinity constitute a "second pipe connecting part" capable of receiving the pipe 70 in such a manner that the pipe 70 is inserted therein. An O-ring 72 for sealing is fitted around an outer surface of the end portion of the pipe 70 so as to prevent leakage of refrigerant to the outside. In addition, a flange portion 74 protruding radially outward is formed in the vicinity of the end portion of the pipe 70. The flange portion 74 is stopped by a side face of the body 2, so that the length to which the pipe 70 is inserted into the second passage 14 is restricted and set. Although these pipes 60 and 70 are fixed to the body 2 with respective pipe fixing plates, which are not shown, the description thereof will be omitted.

Note that the surface of the pipe 70 facing the pipe 60 has an end surface 76 perpendicular to the axis of the second passage 14 and an inclined surface 78 inclined with respect to the end surface 76. In other words, the end opening of the pipe 70 has a tapered shape with an inner diameter increasing toward the end, and the tapered surface thereof constitutes the inclined surface 78. As a result, the end surface of the pipe 70, which is perpendicular to the axis of the second passage 14, is made smaller than that of a pipe 170 of the comparative example shown in FIG. 2B. This means that natural vibration of a gas column is less likely to be caused in the pipe mounting structure of the present embodiment.

Specifically, in the comparative example, such a inclined surface as in the present embodiment is not formed and a large end surface 176 perpendicular to the axis of the second passage 14 is formed at the end opening of the pipe 170 on the downstream side (the downstream-side pipe 170). With this structure, in the second passage 14, a wave of refrigerant introduced through the pipe 60 is likely to be reflected in the axial direction by the end surface 176 of the pipe 170. As a result, a standing wave in a gas column is likely to be produced in a space S between the pipe 60 and the pipe 170, and a gas column having antinodes of the standing wave at the open end of the pipe 60 and the open end of the pipe 170 is likely to be formed. Natural vibration of the gas column is thus relatively likely to be caused. This results in a relatively high likelihood of coincidence between the frequency of the Karman vortex caused on the downstream side of the shaft 33 while the refrigerant passes along the shaft 33 and the natural frequency of the gas column, generating Karman vortex sound.

In contrast, according to the present embodiment, the inclined surface 78 is formed, which makes the end surface 76, which is perpendicular to the axis of the second passage 14, smaller. With this structure, in the second passage 14, a wave of refrigerant introduced through the pipe 60 is less likely to be reflected in the axial direction by the end surface of the pipe 70. As a result, a standing wave in a gas column is less likely to be produced in a space S between the pipe 60 and the pipe 70. Consequently, natural vibration of the gas column is less likely to be caused, and the likelihood of generation of the aforementioned Karman vortex sound is low. The inclined surface 78 of the pipe 70 thus constitutes a "natural vibration suppressing structure."

As described above, according to the present embodiment, the natural vibration suppressing structure prevents or suppresses the natural vibration of the gas column having antinodes of the standing wave at the open end of the pipe 60 and the open end of the pipe 70. This substantially eliminates the effect of the eigenvalue of the space between the open end of the pipe 60 and the open end of the pipe 70. As a result, generation of Karman vortex sound due to coincidence of eigenvalues can be prevented or suppressed regardless of the frequency value of the Karman vortex caused when refrigerant passes along the shaft 33.

Modifications

Figure 3A:
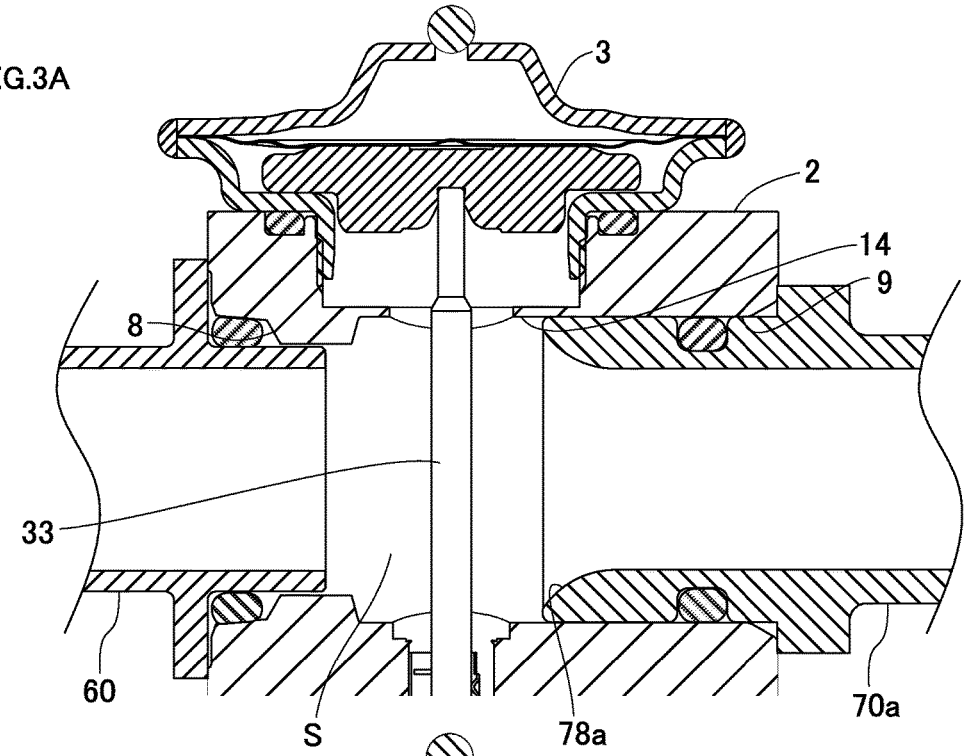
FIGS. 3A and 3B are partially enlarged cross-sectional views of main parts of pipe mounting structures according to modifications.
Figure 3B:
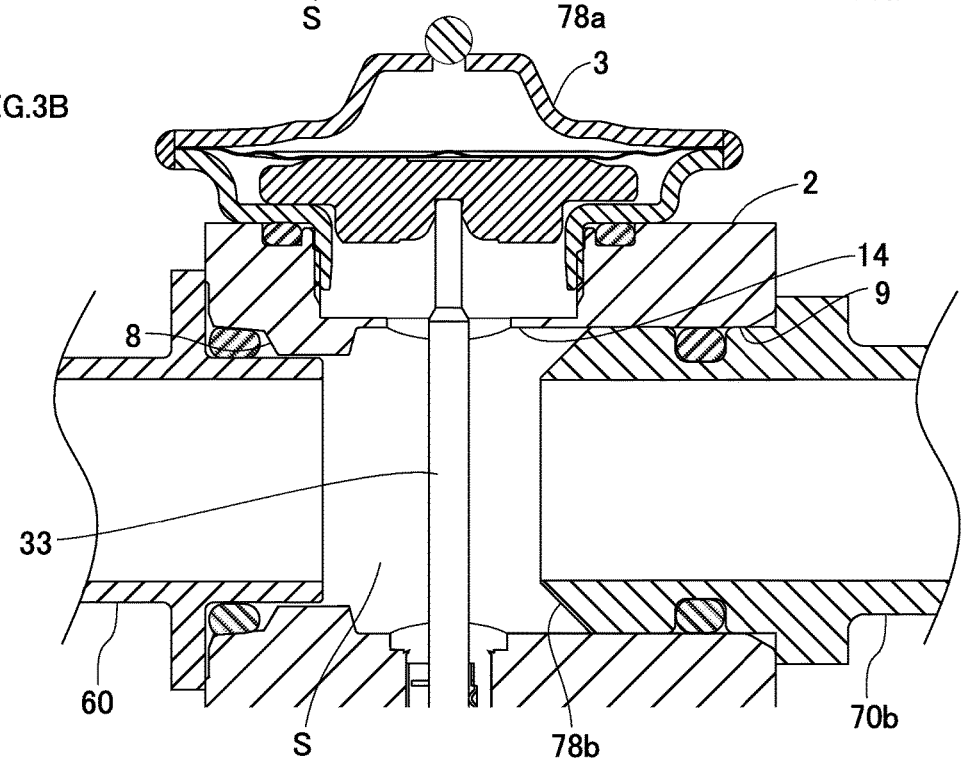

FIGS. 3A and 3B are partially enlarged cross-sectional views of main parts of pipe mounting structures according to modifications. FIG. 3A shows a first modification, and FIG. 3B shows a second modification. As shown in FIG. 3A, in the first modification, an end surface of a pipe 70*a* on the downstream side (a downstream-side pipe 70*a*) is an inclined surface 78*a* having a round shape (R shape). With this structure as well, a surface of the pipe 70*a* perpendicular to the axis of the second passage 14 can be made small. As a result, a wave of refrigerant is less likely to be reflected in the axial direction by the end surface of the pipe 70*a*, and the same effects as those in the first embodiment can be achieved.

Alternatively, as shown in FIG. 3B, in the second modification, an opening of a pipe 70*b* on the downstream side has a tapered shape with an outer diameter decreasing toward the end, and the tapered surface thereof constitutes an inclined surface 78*b*. With this structure as well, a surface of the pipe 70*b* perpendicular to the axis of the second passage 14 can be made small. As a result, a wave of refrigerant is less likely to be reflected in the axial direction by the end surface of the pipe 70*b*, and the same effects as those in the first embodiment can be achieved.

Second Embodiment

Figure 4A:
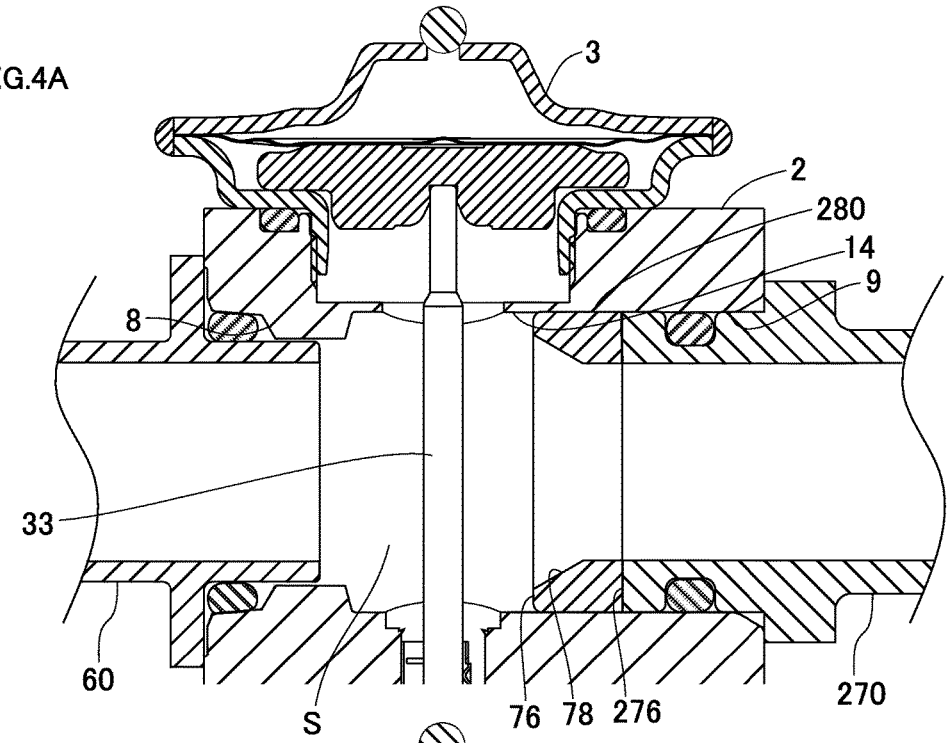
FIGS. 4A and 4B are partially enlarged cross-sectional views of main parts of pipe mounting structures according to a second embodiment.
Figure 4B:
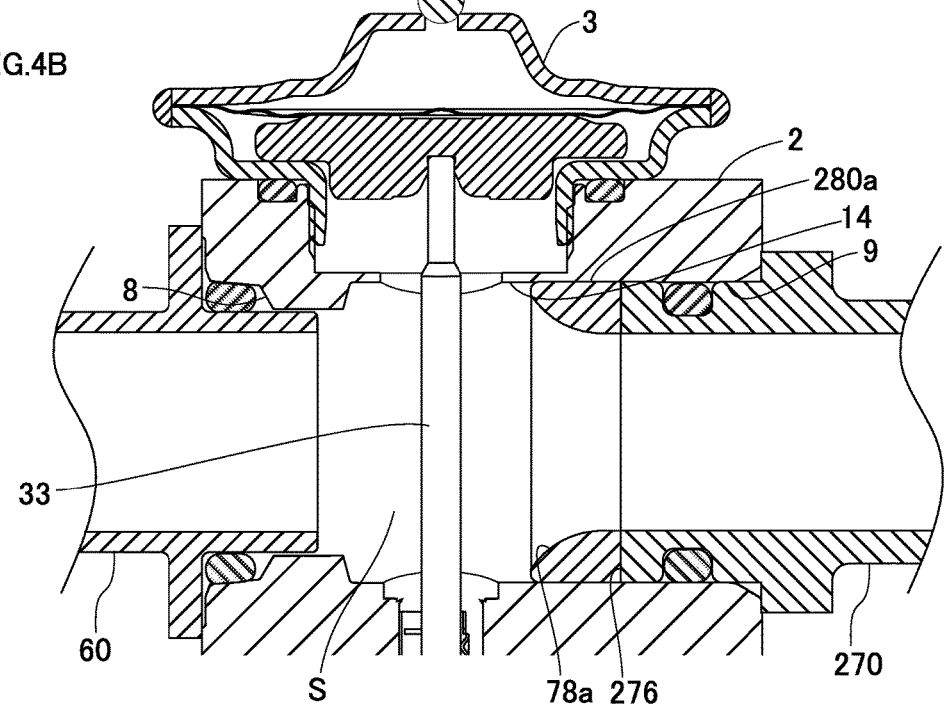

Next, a pipe mounting structure according to a second embodiment will be described. FIGS. 4A and 4B are partially enlarged cross-sectional views of main parts of pipe mounting structures according to the second embodiment. FIG. 4A shows a pipe mounting structure according to the present embodiment, and FIG. 4B shows a pipe mounting structure according to a modification.

As shown in FIG. 4A, in the present embodiment, an annular sound absorbing material 280 is provided on the upstream side of a downstream-side pipe 270. The sound absorbing material 280 is made of a porous material such as glass wool and urethane, and absorbs wave energy that is a cause of sound to attenuate the wave. The sound absorbing material 280 is adhered to a flat end surface 276 of a pipe 270 and has an inclined surface 78 (tapered surface) similar to that in the first embodiment at an end portion thereof. In the present embodiment, the sound absorbing material 280 has an inner diameter equal to that of the pipe 270 as shown. With this structure, a better soundproof effect can be achieved in addition to the effects similar to those in the first embodiment. Furthermore, since the end surface 276 of the pipe 270 may be perpendicular to the axis, the end portion of the pipe 270 need not be subjected to special processing, which results in high versatility.

The structure of the sound absorbing material can be selected from various structures. In the modification shown in FIG. 4B, a sound absorbing material 280*a* has an inclined surface 78*a* of the same round shape as that shown in FIG. 3A. With this structure as well the same effects can be achieved.

Third Embodiment

Figure 5:
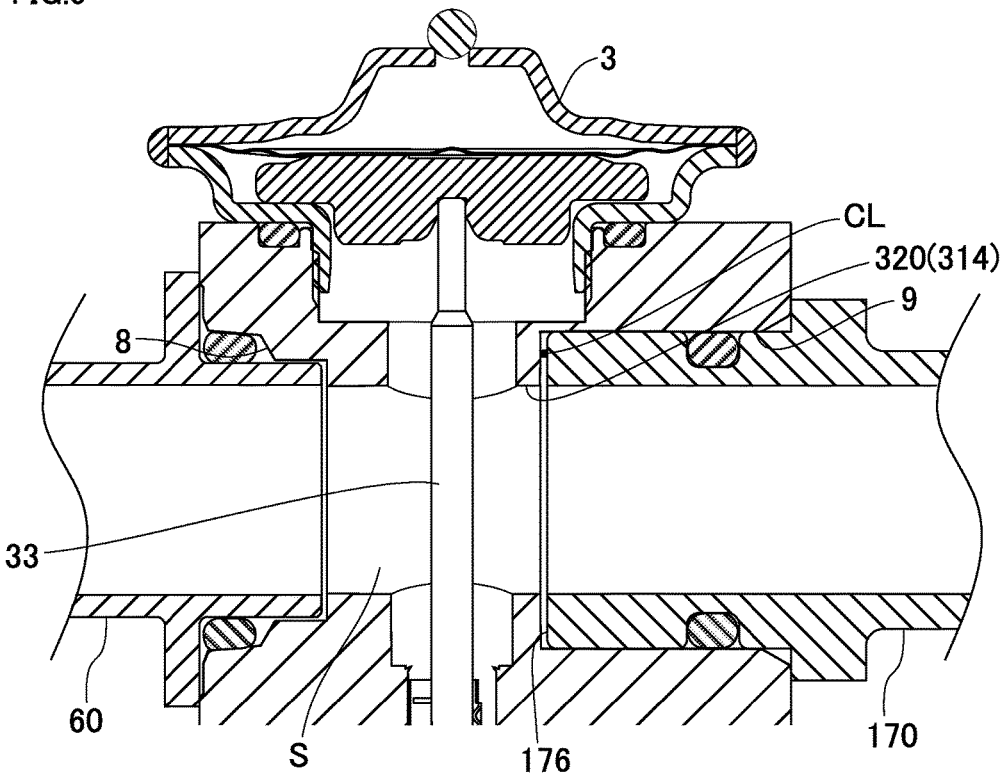
FIG. 5 is a partially enlarged cross-sectional view of a main part of a pipe mounting structure according to a third embodiment.

Next, a pipe mounting structure according to a third embodiment will be described. FIG. 5 is a partially enlarged cross-sectional view of a main part of the pipe mounting structure according to the third embodiment.

In the present embodiment, the pipe 170 of the comparative example shown in FIG. 2B is employed. In a second passage 314, however, the inner diameter of an intermediate portion 320 between the pipe 60 and the pipe 170 is equal to the inner diameters of the pipes 60 and 170. In other words, a structure with substantially no steps between the inner surface of the intermediate portion 320 and the inner surfaces of the pipes 60 and 170 is provided. With such a structure, a gas column having antinodes of a standing wave at the open end of the pipe 60 and the open end of the pipe 170 is less likely to be formed. Consequently, the likelihood of the frequency of the Karman vortex caused on the downstream side of the shaft 33 while the refrigerant passes along the shaft 33 and the natural frequency of the gas column becoming coincident with each other, generating Karman vortex sound, is low. Thus, generation of Karman vortex sound due to coincidence of eigenvalues can be prevented or suppressed.

In a case where a clearance CL is formed between the intermediate portion 320 of the second passage 314 and the pipe 170 as in the present embodiment, however, flow noise like wind noise may be caused while the refrigerant passes through the clearance CL. The inventors have verified that the flow noise is more noticeable as the depth (radial length) of the clearance is larger. This flow noise can be reduced by employing modifications as follows.

Modifications

Figure 6A:
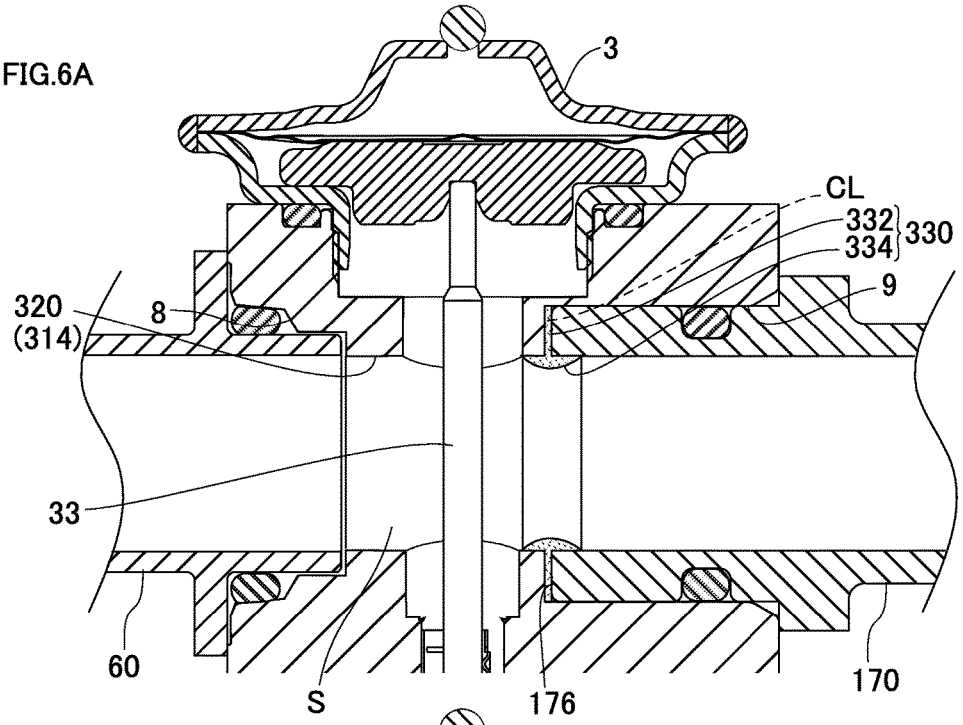
FIGS. 6A and 6B are partially enlarged cross-sectional views of main parts of pipe mounting structures according to modifications.
Figure 6B:
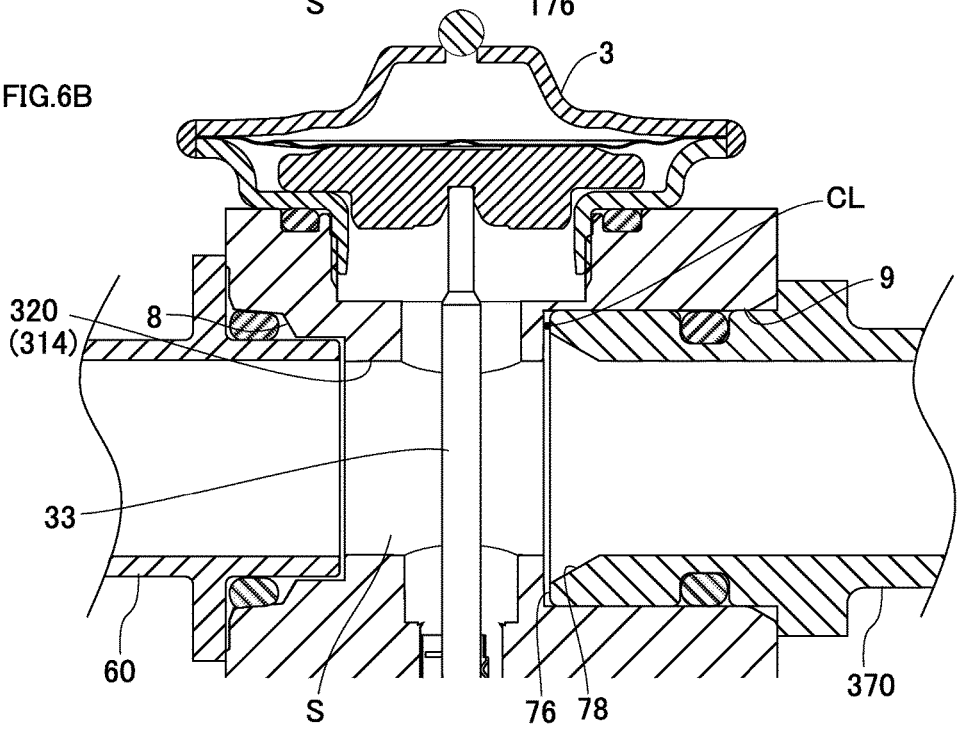
Figure 7A:
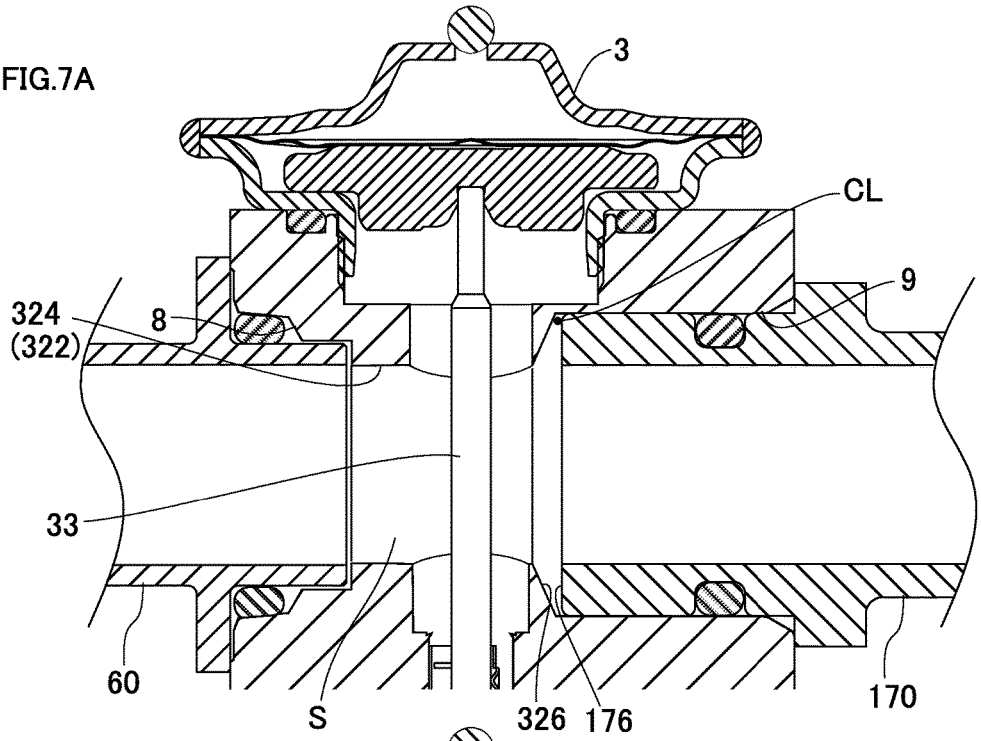
FIGS. 7A and 7B are partially enlarged cross-sectional views of main parts of pipe mounting structures according to modifications.
Figure 7B:
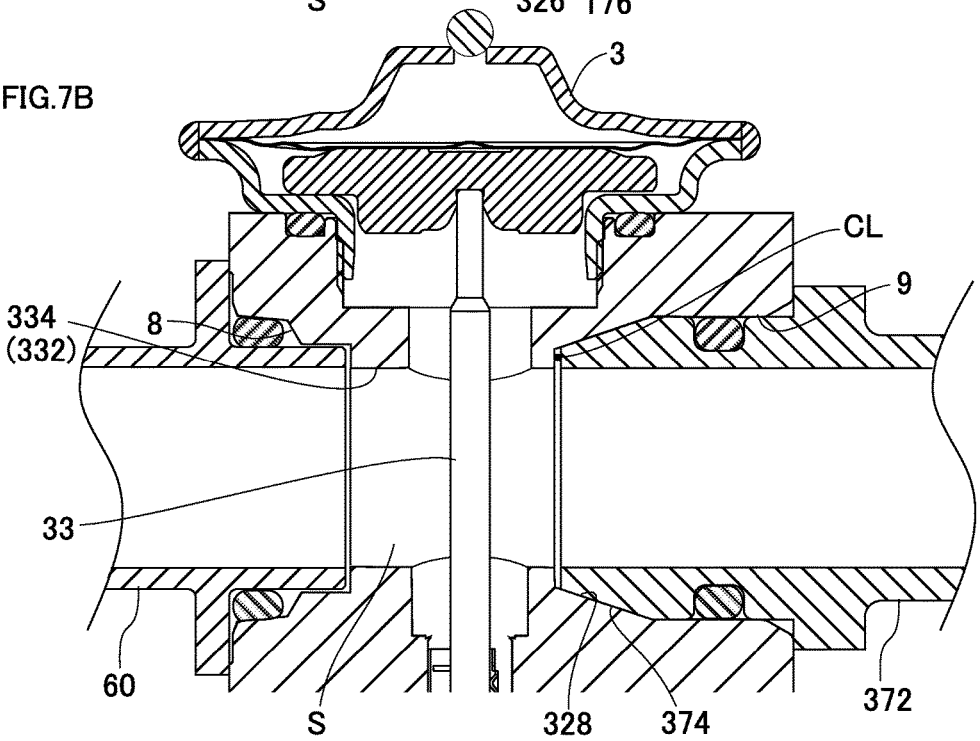

FIGS. 6A, 6B, 7A, and 7B are partially enlarged cross-sectional views of main parts of pipe mounting structures according to modifications. FIG. 6A shows a first modification and FIG. 6B shows a second modification. FIG. 7A shows a third modification and FIG. 7B shows a fourth modification.

In the first modification shown in FIG. 6A, a sealing member 330 for sealing the clearance CL between the intermediate portion 320 of the second passage 314 and the pipe 170 is provided. The sealing member 330 is an annular member made of an elastic material such as rubber, and includes a flange-like seal portion 332 positioned in the clearance CL and a seal-up portion 334 in close contact with inner surfaces of both the second passage 314 and the pipe 170 to seal up the opening of the clearance CL. In the present embodiment, the sealing member 330 is first attached to the end of the pipe 170, and the pipe 170 in this state is inserted into the outlet port 9. In this manner, the pipe 170 is mounted onto the body 2 and attachment of the sealing member 330 to the second passage 314 is completed at the same time. Such a structure closes the clearance CL, and thus prevents or reduces the aforementioned flow noise.

In the second modification shown in FIG. 6B, an end opening of a pipe 370 on the downstream side (a downstream-side pipe 370) is tapered similarly to the pipe 70 of FIG. 2A. Specifically, an inclined surface 78 (tapered surface) with an inner diameter increasing toward the end of the pipe 370 is formed, which makes the depth of the clearance CL (narrow portion) smaller. Such a structure reduces the flow noise.

In the third modification shown in FIG. 7A, conversely, a pipe 170 on the downstream side is as shown in FIG. 5 and an intermediate portion 324 of a second passage 322 is tapered. Specifically, a surface of the intermediate portion 324 facing the pipe 170 is an inclined surface 326 (tapered surface). Such a structure can also make the depth of the clearance CL (narrow portion) smaller, and thus reduces the flow noise.

In the fourth modification shown in FIG. 7B, an intermediate portion 334 of a second passage 332 and a pipe 372 on the downstream side have inclined surfaces 328 and 374 (tapered surfaces), respectively, which are complementary to each other. Such a structure can also make the depth of the clearance CL (narrow portion) smaller, and thus reduces the flow noise.

In the present embodiment, the pipe 60 on the upstream side has a thicker cross-section than the pipe 170 on the downstream side as shown in FIG. 5. For this reason, the measures against the flow noise are taken only on the pipe on the downstream side in the first to fourth modifications. Needless to say, however, similar measures may also be taken on the pipe on the upstream side.

The description of the present invention given above is based upon illustrative embodiments. These embodiments are intended to be illustrative only and it will be obvious to those skilled in the art that various modifications could be further developed within the technical idea underlying the present invention.

Figure 8A:
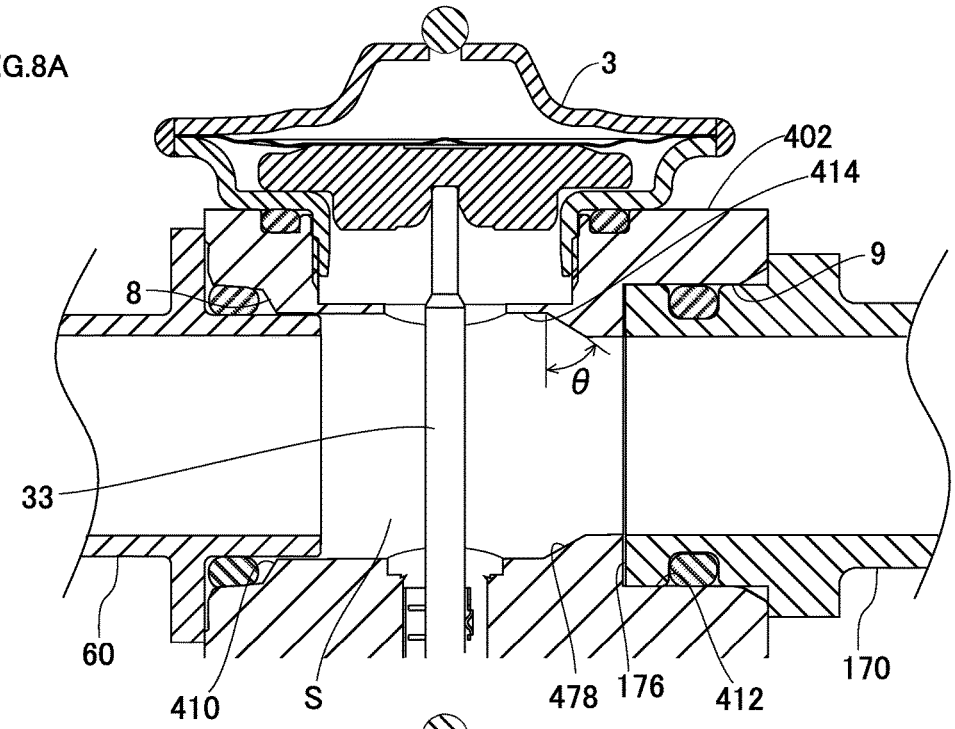
FIGS. 8A and 8B are partially enlarged cross-sectional views of main parts of pipe mounting structures according to modifications.
Figure 8B:
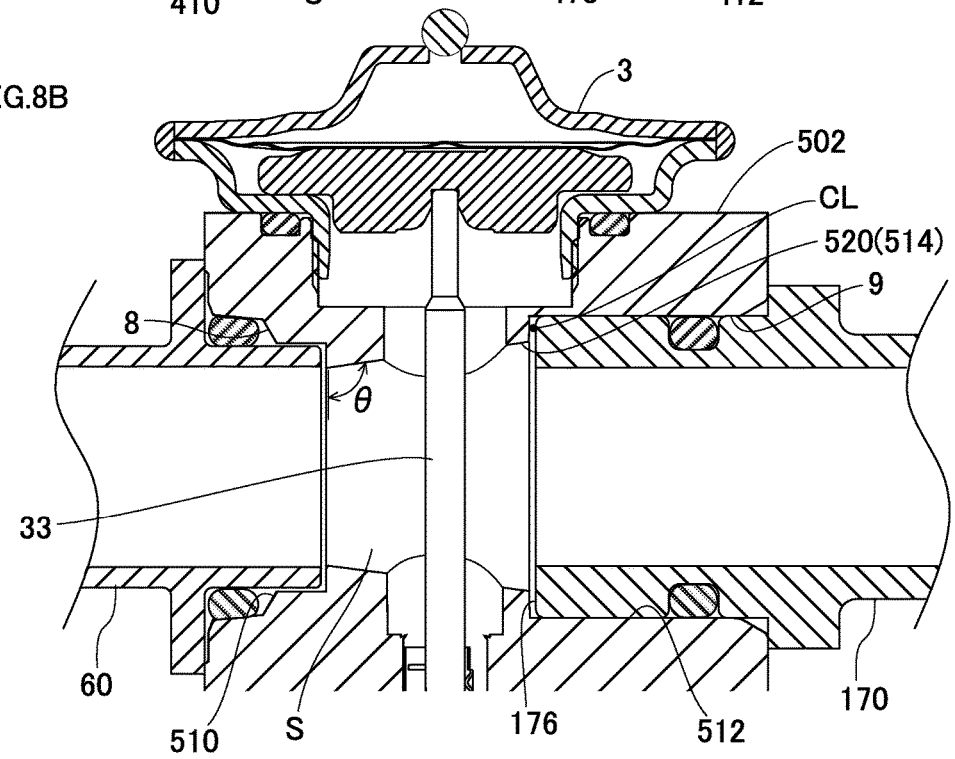
Figure 9A:
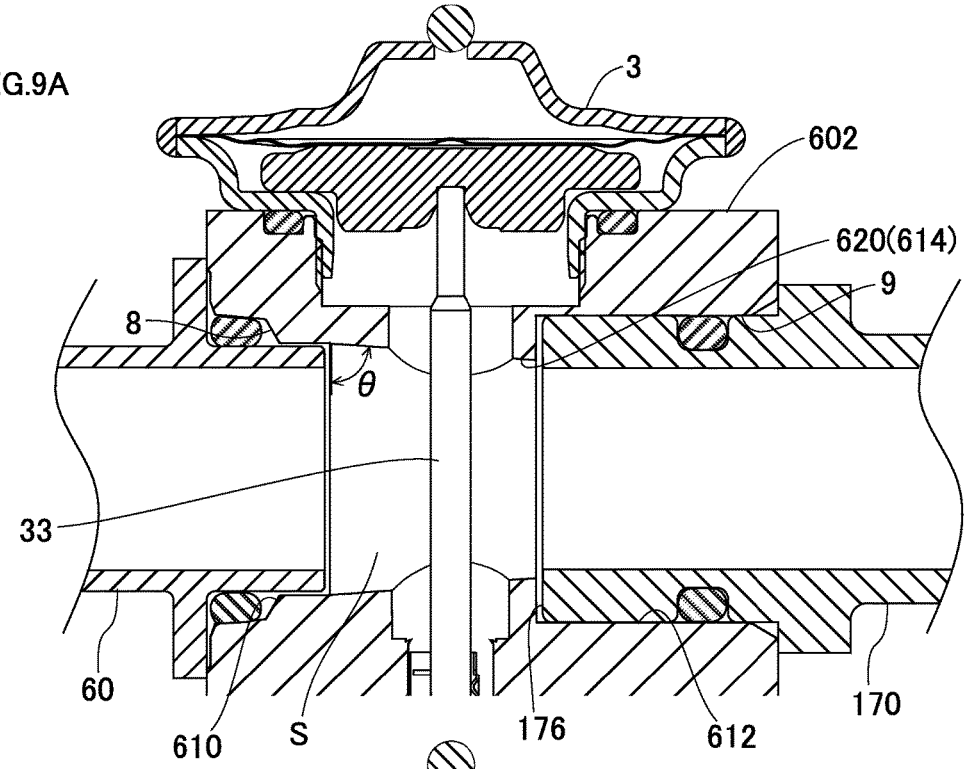
FIGS. 9A and 9B are partially enlarged cross-sectional views of main parts of pipe mounting structures according to modifications.
Figure 9B:
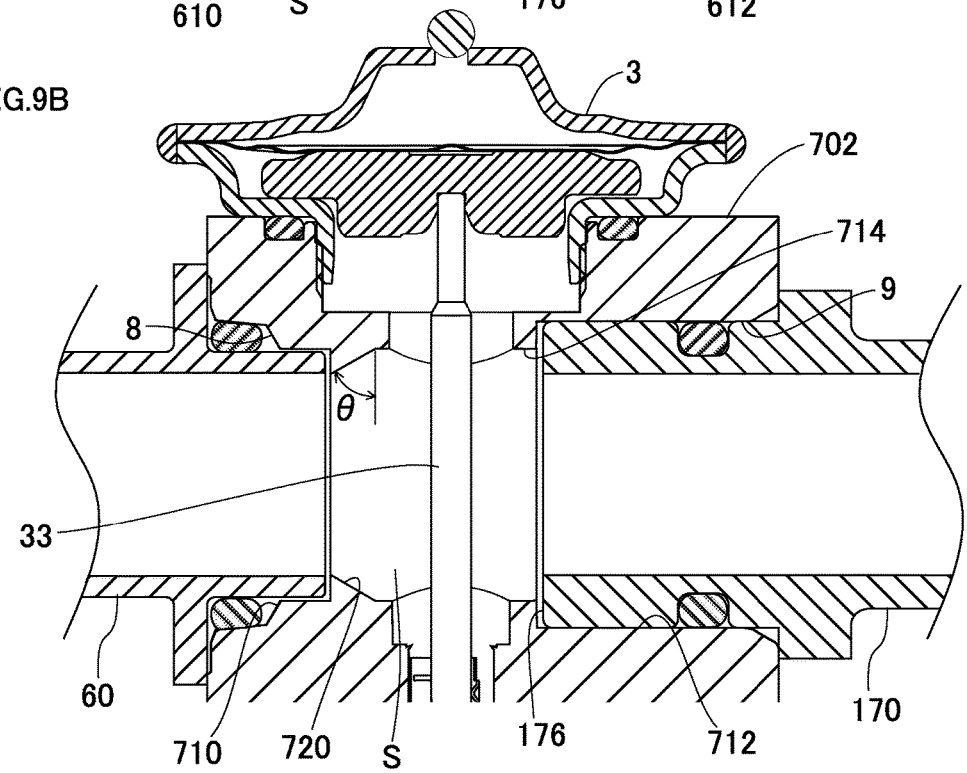

FIGS. 8A, 8B, 9A, and 9B are partially enlarged cross-sectional views of main parts of pipe mounting structures according to modifications. FIG. 8A shows a fifth modification, and FIG. 8B shows a sixth modification. FIG. 9A shows a seventh modification, and FIG. 9B shows an eighth modification.

While examples in which an inclined surface is formed on the pipe itself on the downstream side or the member fixed to the pipe have been presented in the first and second embodiments, the inclined surface may alternatively be formed on the body. In the fifth modification shown in FIG. 8A, an inclined surface 478 (natural vibration suppressing structure) is formed on a portion of a body 402 between a first pipe connecting part 410 and a second pipe connecting part 412. The inclined surface 478 is located on the downstream side of the shaft 33. In this modification, the inclined surface 478 facing the pipe 60 on the upstream side is formed on a second passage 414 and the downstream side of the inclined surface 478 on the second passage 414 is increased in diameter to form the second pipe connecting part 412, where the pipe 170 on the downstream side is mounted. The inclined surface 478 faces the end opening of the pipe 60 connected to the first pipe connecting part 410 in the axial direction. This enables reflection of a gaseous refrigerant flowing from the upstream side at an angle with respect to the axis. In this modification, in particular, the angle θ of the inclined surface 478 with respect to a plane perpendicular to the axis of the second passage 414 is 45 degrees or larger, so that the gaseous refrigerant is less likely to be reflected toward the upstream side. Since the presence of the inclined surface 478 allows the gaseous refrigerant to be reflected in a direction deviated from the axis, the natural vibration of a gas column is prevented or suppressed.

Such a structure eliminates the need for formation of special structures in the pipes 60 and 170 and the need for addition of another member for forming an inclined surface. A versatile pipe can thus be used without being subjected to any processing. Furthermore, since the pipe 170 on the downstream side is disposed outside of the space S as shown, the space inside the body 402 can effectively be used and the expansion valve can be made compact.

In the sixth modification shown in FIG. 8B, an inclined surface 520 is formed on a portion of a body 502 between a first pipe connecting part 510 and a second pipe connecting part 512. The inclined surface 520 is such a tapered surface that the cross-section of an intermediate portion of the second passage 514 becomes larger toward the downstream side. In this modification, in particular, the inclined surface 520 is formed over the entire area between the first pipe connecting part 510 and the second pipe connecting part 512, and the inner diameter of an upstream-side open end of the intermediate portion, which corresponds to a base end of the inclined surface 520 is equal to the inner diameter of an open end of the pipe 60. Furthermore, the angle θ of the inclined surface 520 with respect to a plane perpendicular to the axis of the second passage 514 is 45 degrees or larger. With such a structure, even when a wave of gaseous refrigerant is reflected toward the upstream side in the second passage 514, the refrigerant is reflected in a direction deviated from the axis by the inclined surface 520 and the natural vibration of a gas column is thus prevented or suppressed. As a result, generation of Karman vortex sound can be prevented or suppressed regardless of the frequency value of the Karman vortex. Furthermore, since the intermediate portion of the second passage 512 is formed in a tapered shape as described above, the depth of a clearance CL (narrow portion) between the intermediate portion and the pipe 170 can be made small, and the flow noise can thus be reduced.

In the seventh modification shown in FIG. 9A, an inclined surface 620 is formed on a portion of a body 602 between the first pipe connecting part 610 and the second pipe connecting part 612. The inclined surface 620 is such a tapered surface that the cross-section of an intermediate portion of the second passage 614 becomes smaller toward the downstream side, contrary to the sixth modification. In this modification, in particular, the inclined surface 620 is formed over the entire area between the first pipe connecting part 610 and the second pipe connecting part 612. Furthermore, the angle θ of the inclined surface 620 with respect to a plane perpendicular to the axis of the second passage 614 is 45 degrees or larger. With such a structure, even when a wave of gaseous refrigerant is reflected toward the upstream side in the second passage 614, the refrigerant is reflected in a direction deviated from the axis and the natural vibration of a gas column is thus prevented or suppressed.

In the eighth modification shown in FIG. 9B, an inclined surface 720 is formed on part of a portion of a body 702 between the first pipe connecting part 710 and the second pipe connecting part 712. The inclined surface 720 is a tapered surface formed on the upstream side of the shaft 33 and faces the end opening of the pipe 170 in the axial direction. In this modification, in particular, the angle θ of the inclined surface 720 with respect to a plane perpendicular to the axis of a second passage 714 is 45 degrees or larger. With such a structure, even when a wave of gaseous refrigerant is reflected toward the upstream side by the end surface 176 of the pipe 170, the refrigerant is reflected in a direction deviated from the axis by the inclined surface 720 and the natural vibration of a gas column is thus prevented or suppressed.

In the second embodiment, an example in which the sound absorbing material has an inclined surface has been presented. In a modification, such an inclined surface may not be formed, so that only the effect of attenuating the standing wave of a gas column is achieved with use of the sound absorbing material.

Although the expansion valve of the embodiments described above is suitably applicable to a refrigeration cycle using an alternative for chlorofluorocarbon (HFC-134a) or the like as the refrigerant, the expansion valve of the present invention can also be applied to a refrigeration cycle using a refrigerant such as carbon dioxide with high working pressure. In this case, an external heat exchanger such as a gas cooler is provided instead of the condenser in the refrigeration cycle. In this case, disc springs made of metal, for example, may be stacked in order to reinforce the diaphragm included in the power element 3.

In the embodiments described above, examples in which the expansion valve is a valve for throttling and expanding a refrigerant having flowed therein via an external heat exchanger and supplying the resulting refrigerant to an evaporator (internal evaporator) have been provided. In a modification, the expansion valve may be applied to a heat pump automotive air conditioner and disposed downstream of an internal heat exchanger. Specifically, the expansion valve may be a valve for throttling and expanding a refrigerant having flowed therein via an internal heat exchanger and supplying the resulting refrigerant to an external heat exchanger (external evaporator).

The present invention is not limited to the above-described embodiments and modifications only, and those components may be further modified to arrive at various other embodiments without departing from the scope of the invention. Also, various other embodiments may be further formed by combining, as appropriate, a plurality of structural components disclosed in the above-described embodiments and modification. Also, one or some of all of the components exemplified in the above-described embodiments and modifications may be left unused or removed.

What is claimed is:

1. An expansion valve provided in a refrigeration cycle and configured to throttle and expand refrigerant passing through a valve section, the refrigerant being introduced via a heat exchanger, supply the expanded refrigerant to an evaporator, sense pressure and temperature of refrigerant having returned from the evaporator to control an opening degree of the valve section, and deliver the refrigerant toward a compressor, the expansion valve comprising:

a body having a first inlet port through which the refrigerant from the heat exchanger is introduced, a first outlet port through which the refrigerant is delivered toward the evaporator, a first passage connecting the first inlet port and the first outlet port, a valve hole formed in an intermediate portion of the first passage, a second inlet port through which the refrigerant having returned from the evaporator is introduced, a second outlet port through which the refrigerant is delivered toward the compressor, and a second passage connecting the second inlet port and the second outlet port;

a valve element configured to move toward and away from the valve hole to close and open the valve section;

a power element provided on the body on a side opposite to the first passage with respect to the second passage and configured to sense temperature and pressure of the refrigerant flowing through the second passage and operate in response to the sensed temperature and pressure; and a shaft having a first end side extending across the second passage and connected to the power element and a second end side extending through a partition between the first passage and the second passage and connected to the valve element, the shaft being configured to transmit drive force of the power element to the valve element, wherein the body has:

a first pipe connecting part configured to receive a first pipe, which is connected to an outlet side of the evaporator, in such a manner that the first pipe is inserted into the second inlet port;

a second pipe connecting part configured to receive a second pipe, which is connected to an inlet side of the compressor, in such a manner that the second pipe is inserted into the second outlet port; and an inclined surface between the first pipe connecting part and the second pipe connecting part, the inclined surface facing an end opening of the second pipe connected to the second pipe connecting part in an axial direction of the second pipe, the inclined surface inclined at an angle of 45 degrees or larger with respect to a plane perpendicular to an axis of the second passage, the inclined surface including an opening through which the shaft extends, and wherein the inclined surface extends over an entire area between the first pipe connecting part and the second pipe connecting part.

2. The expansion valve according to claim 1, wherein the inclined surface has a tapered shape such that a cross section of the second passage increases at an angle from an end of the inclined surface on a side of the first pipe connecting part toward another end of the inclined surface on a side of the second pipe connecting part.

3. The expansion valve according to claim 1, wherein an inner diameter of an upstream-side open end of an intermediate portion of the second passage, corresponding to a base end of the inclined surface, is equal to an inner diameter of an open end of the first pipe.

* * * * *